US009726400B2

(12) United States Patent
Mase

(10) Patent No.: US 9,726,400 B2
(45) Date of Patent: Aug. 8, 2017

(54) HOT WATER SUPPLY DEVICE

(71) Applicant: RINNAI CORPORATION, Nagoya-shi, Aichi (JP)

(72) Inventor: Naoto Mase, Aichi (JP)

(73) Assignee: RINNAI CORPORATION, Nagoya-shi (JP)

( * ) Notice: Subject to any disclaimer, the term of this patent is extended or adjusted under 35 U.S.C. 154(b) by 384 days.

(21) Appl. No.: 14/446,770

(22) Filed: Jul. 30, 2014

(65) Prior Publication Data

US 2016/0033171 A1 Feb. 4, 2016

(51) Int. Cl.

| | |
|---|---|
| ***F24H 1/14*** | (2006.01) |
| ***F24H 9/20*** | (2006.01) |
| *F24H 1/12* | (2006.01) |
| *F24H 1/10* | (2006.01) |

(52) U.S. Cl.

CPC ..... *F24H 9/2035* (2013.01); *F24H 1/145* (2013.01); *F24H 1/10* (2013.01); *F24H 1/12* (2013.01); *F24H 9/20* (2013.01); *F24H 9/2007* (2013.01); *F24H 9/2028* (2013.01)

(58) Field of Classification Search

CPC ..... F24H 9/20; F24H 9/2007; F24H 9/2035; F24H 9/2028; F24H 1/10; F24H 1/12; F24H 1/14; F24H 1/145; F22B 27/00; F27B 35/005

USPC ..... 122/14.3, 14.31, 17.1, 18.1

See application file for complete search history.

(56) References Cited

U.S. PATENT DOCUMENTS 3,351,739 A * 11/1967 Eckman ..... H05B 1/0208 219/486
4,638,147 A * 1/1987 Dytch ..... G05D 23/1912 219/484
2007/0257122 A1 11/2007 Shimada et al.
2013/0214053 A1* 8/2013 Narita ..... F24H 9/2035 237/8 R
2014/0060458 A1 3/2014 Fujimoto

FOREIGN PATENT DOCUMENTS

| | | |
|---|---|---|
| JP | 2003-254615 | 9/2003 |
| JP | 2008-138952 | 6/2008 |
| JP | 2008138952 A * | 6/2008 |

OTHER PUBLICATIONS

European Communication dated Jan. 27, 2015, 6 pages.

* cited by examiner

*Primary Examiner* — Alissa Tompkins
*Assistant Examiner* — Benjamin W Johnson
(74) *Attorney, Agent, or Firm* — Rankin, Hill & Clark LLP

(57) ABSTRACT

The present invention provides a hot water supply device. When a hot water supply operation is started in response to an instruction for checking a heat exchange state, a heat exchange state determiner 12 measures a post-boiling temperature Tup, which indicates the rise width of a temperature detected by a heat exchange outlet temperature sensor 26 from the point when the hot water supply operation stopped, and outputs a heat exchange success report if the post-boiling temperature Tup is lower than a first threshold temperature. Further, when the hot water supply operation is started independently of the instruction for checking a heat exchange state, the heat exchange state determiner 12 outputs a report of clogging of a heat exchanger if the post-boiling temperature Tup is higher than a second threshold temperature Bth, which is higher than the first threshold temperature Ath.

4 Claims, 6 Drawing Sheets

HOT WATER SUPPLY DEVICE

BACKGROUND OF THE INVENTION

Field of the Invention

The present invention relates to a hot water supply device which heats water running in a heat exchanger by a burner to supply hot water.

Description of the Related Art

Hitherto, there has been known a hot water supply device which is provided with a heat exchanger connected to a water supply pipe and a hot water supply pipe and a burner that heats the heat exchanger, and which is adapted to heat water running in the heat exchanger (refer to, for example, Japanese Patent Application Laid-Open No. 2008-138952).

Water is supplied from waterworks through a hot water supply pipe to a heat exchanger installed in the hot water supply device. The water supplied from waterworks frequently contains dissolved impurities, such as calcium carbonate and calcium hydroxide. The impurities that crystalize in a water path (heat transfer pipe) in the heat exchanger and turn into lime scale adhering to the heat transfer pipe interfere with the heat transfer in the heat exchanger, resulting in deteriorated performance of the hot water supply device.

In the hot water supply device described in the foregoing gazette, therefore, a failure of the heat exchanger caused by the adhesion of lime scale is detected by making use of the fact that, as the lime scale builds up in the heat transfer pipe of the heat exchanger, the temperature of the water in the heat exchanger increases due to residual heat (post-boiling temperature) when the supply of hot water is stopped.

When a failure of the heat exchanger caused by the adhesion of lime scale is detected, a cleaning pipe for removing the scale is connected to the water circulating path of the hot water supply device including the heat exchanger thereby to form a circulation circuit. Then, a cleaning liquid is circulated in the circulation circuit by a pump to remove the lime scale adhering to the heat transfer pipe of the heat exchanger.

However, incomplete removal of the lime scale by the cleaning leads to the detection of a failure of the heat exchanger caused by the adhesion of scale within a short period of time after the cleaning pipe is disconnected and the use of the hot water supply device is resumed, thus inconveniently resulting in the need for removing the scale again.

SUMMARY OF THE INVENTION

The present invention has been made in view of the foregoing background, and an object of the invention is to provide a hot water supply device that makes it possible to check that a heat exchanger has been successfully cleaned.

A hot water supply device in accordance with the present invention includes:

a heat exchanger connected to a water supply pipe and a hot water supply pipe;

a burner that heats the heat exchanger;

a heat exchange outlet temperature sensor that detects a temperature of water in the heat exchanger or the hot water supply pipe in the vicinity of a place where the heat exchanger and the hot water supply pipe are connected;

a running water sensor that detects for a presence of running water in the heat exchanger;

a hot water supply controller that carries out a hot water supply operation in which the burner is turned on to heat water circulating in the heat exchanger in a case where running water is detected by the running water sensor, and turns the burner off to stop the hot water supply operation in a case where the running water is not detected by the running water sensor; and a heat exchange state determiner which, in a case where the hot water supply operation stops after the hot water supply operation is started in response to a predetermined instruction for checking a heat exchange state, carries out heat exchange success determination processing in which a post-boiling temperature indicating a rise width of a temperature detected by the heat exchange outlet temperature sensor from a time point at which the hot water supply operation was stopped is measured and the post-boiling temperature and a first threshold temperature are compared, and performs a predetermined successful heat exchange notification in a case where the post-boiling temperature is lower than the first threshold temperature, and carries out, in a case where the hot water supply operation stops after the hot water supply operation is started independently of the instruction for checking a heat exchange state, heat exchanger clogging determination processing in which the post-boiling temperature is measured and the post-boiling temperature is compared with a second threshold temperature, which is higher than the first threshold temperature, and performs a predetermined heat exchanger clogging notification in a case where the post-boiling temperature is higher than the second threshold temperature.

According to the present invention, if clogging of the heat exchanger caused by a lime scale worsens, then the clogging of the heat exchanger is notified when the heat exchanger clogging determination processing is carried out by the heat exchange state determiner. The notification of the clogging of the heat exchanger enables a user to recognize the clogging of the heat exchanger and ask a maintenance service or the like for cleaning the heat exchanger.

Further, upon completion of the cleaning operation of the heat exchanger, an operator of a maintenance service or the like can carry out the heat exchange success determination processing through the heat exchange state determiner by giving an instruction for checking the heat exchange state. In the heat exchange success determination processing, the post-boiling temperature is compared with the first threshold temperature, which is lower than the second threshold temperature used in the heat exchanger clogging determination processing, and the notification of heat exchange success is given when the post-boiling temperature is lower than the first threshold temperature. This enables the operator to confirm that the heat exchanger has been successfully cleaned by recognizing the notification of cleaning completion.

Further, in the present invention, in a case where the instruction for checking the heat exchange state is issued, the heat exchange state determiner causes the hot water supply controller to carry out the hot water supply operation such that the temperature detected by the heat exchange outlet temperature sensor becomes a predefined determination temperature. The first threshold temperature is set according to the determination temperature.

In this case, whether the heat exchanger has been successfully cleaned can be determined with higher accuracy by carrying out the heat exchange success determination processing on the basis of the post-boiling temperature from the state in which the temperature of the water in the vicinity of the outlet of the heat exchanger is maintained at the determination temperature.

Further, according to the present invention, in a case where the post-boiling temperature is the first threshold temperature or higher in the heat exchange success determination processing, the heat exchange state determiner performs a notification that urges the cleaning of the heat exchanger.

With this arrangement, it is possible to urge the operator to clean the heat exchanger again if the heat exchanger has been incompletely cleaned. This makes it possible to prevent the operator from finishing the cleaning of the heat exchanger even in a state the heat exchanger is inadequately cleaned.

DESCRIPTION OF THE PREFERRED EMBODIMENTS

Figure 1:
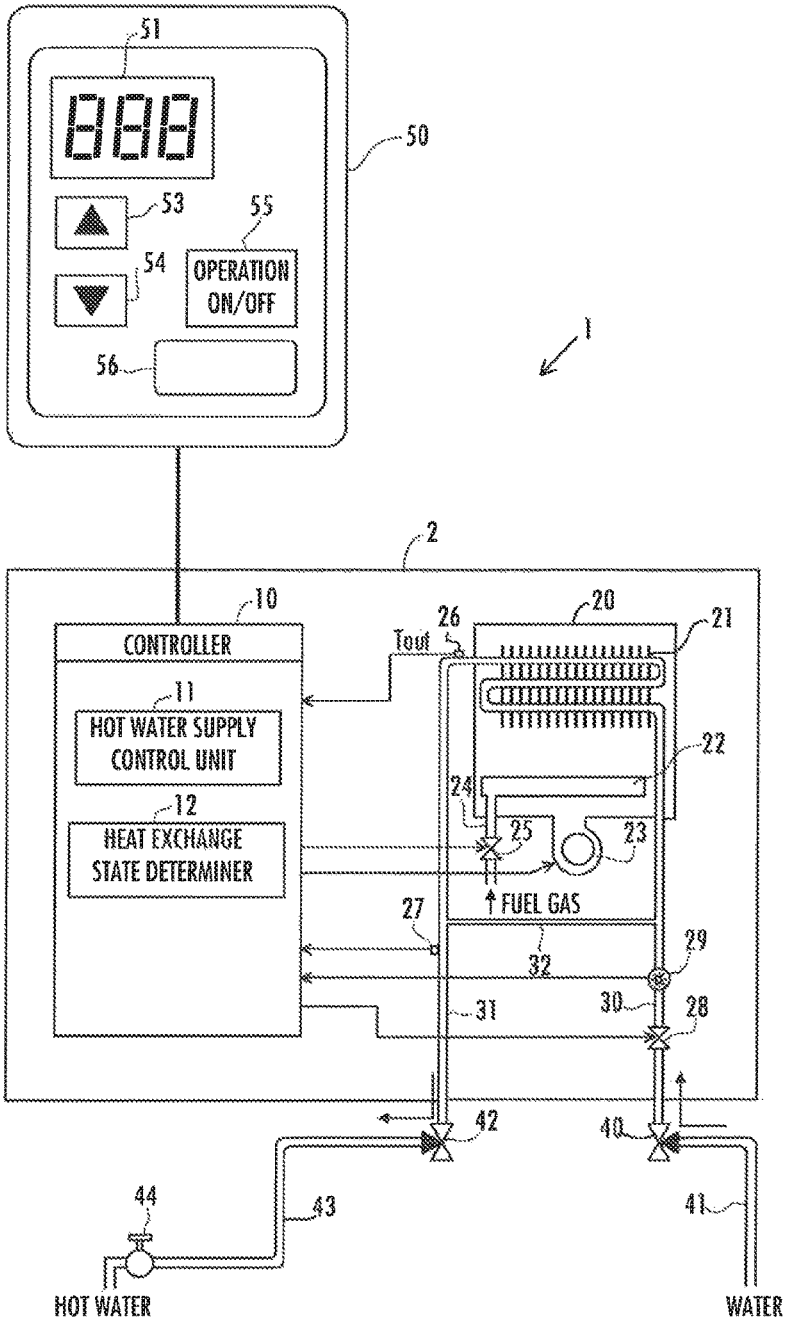
FIG. 1 is a configuration diagram of a hot water supply device.

An embodiment of the present invention will be described with reference to FIG. 1 to FIG. 6. Referring to FIG. 1, a hot water supply device 1 of the present embodiment is constituted of a main unit 2 and a remote control 50 connected to the main unit 2 by a communication cable 60.

The main unit 2 includes a heat exchanger 21 provided in a combustion chamber 20, a burner 22 which is disposed below the heat exchanger 21 to heat the heat exchanger 21, a combustion fan 23 which supplies combustion air to the burner 22, and a gas proportional valve 25 which is provided on a gas supply pipe 24 connected to the burner 22 and which changes the flow rate of a fuel gas supplied to the burner 22.

The inlet end of the heat exchanger 21 is connected to a water supply pipe 30, while the outlet end of the heat exchanger 21 is connected to a hot water supply pipe 31. Further, a bypass pipe 32 is provided to set communication between the water supply pipe 30 and the hot water supply pipe 31, bypassing the heat exchanger 21.

Figure 3:
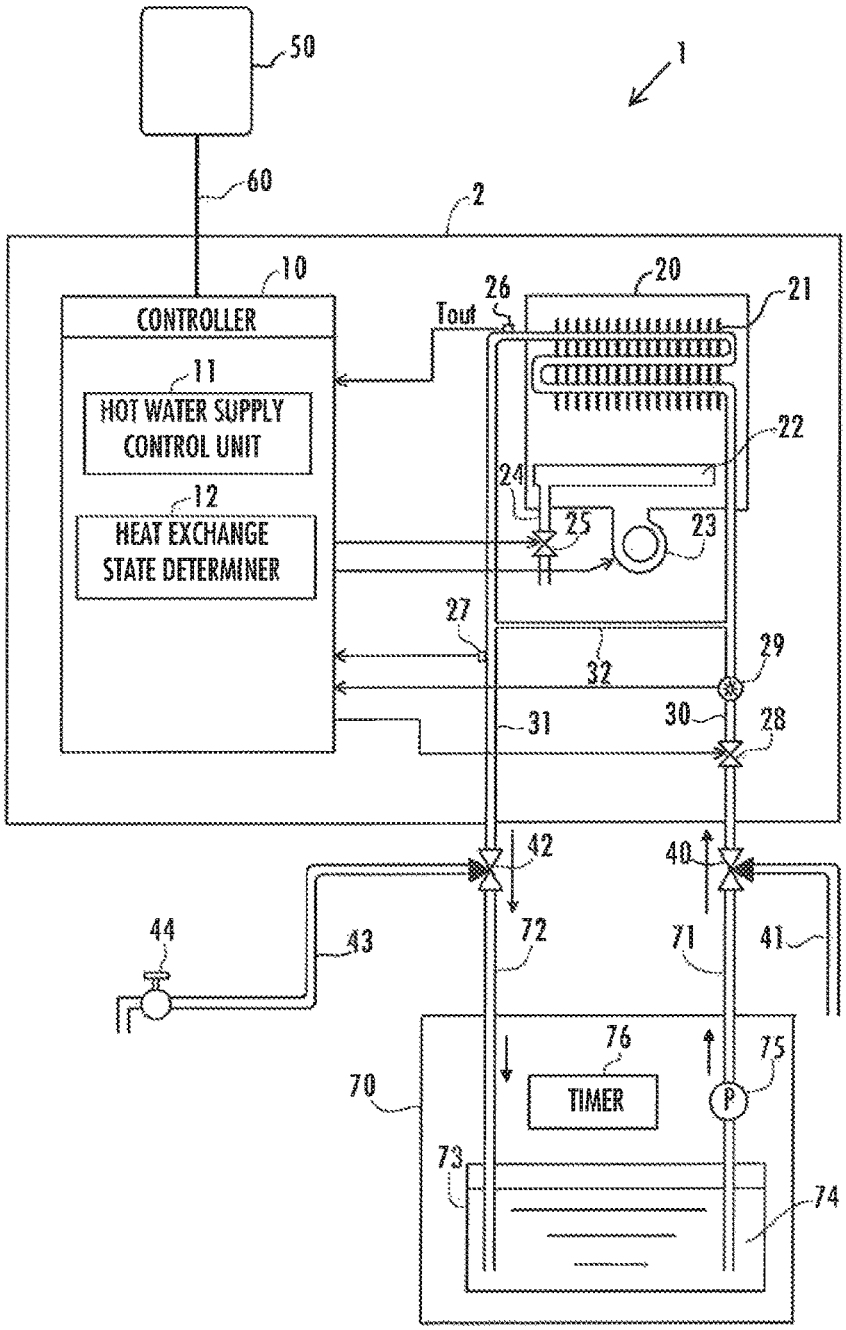
FIG. 3 is an explanatory diagram illustrating a connected state of a cleaning machine is connected.

The water supply pipe 30 is connected to a water pipe 41 via a manual water supply switching valve 40, and the hot water supply pipe 31 is connected to a hot water supply piping 43 via a manual hot water supply switching valve 42. In FIG. 1 and FIG. 3, which will be discussed hereinafter, the locations of open valves of the water supply switching valve 40 and the hot water supply switching valve 42 are indicated by blank triangles, while the locations of closed valves thereof are indicated by black triangles.

Referring to FIG. 1, the lower valves of the water supply switching valve 40 and the hot water supply switching valve 42 are closed, the water pipe 41 and the water supply pipe 30 are set in communication at the water supply switching valve 40, and the hot water supply piping 43 and the hot water supply pipe 31 are set in communication at the hot water supply switching valve 42. Hence, when a user turns on a faucet 44, water is supplied from the water pipe 41 to the water supply pipe 30, the water that has been heated by the heat exchanger 21 and the water passing through the bypass pipe 32 are mixed to be supplied through the faucet 44 from the hot water supply pipe 31 via the hot water supply piping 43, as indicated by the arrows.

Provided on the upstream side of the point of the water supply pipe 30 at which the water supply pipe 30 is connected with the bypass pipe 32 is a running water sensor 29, which detects the flow rate of water circulating through the water supply pipe 30 (corresponding to the running water sensor that detects for the presence of running water in the heat exchanger in the present invention), and a water supply variable valve 28, which changes the opening degree of the water supply pipe 30.

A heat exchange outlet temperature sensor 26, which detects the temperature of water in the hot water supply pipe 31, is provided in the vicinity of the point of the hot water supply pipe 31 at which the hot water supply pipe 31 is connected with heat exchanger 21. A hot water supply temperature sensor 27, which detects the temperature of hot water supplied from the hot water supply pipe 31 to the hot water supply piping 43, is provided on the downstream side of the point of the hot water supply pipe 31 at which the hot water supply pipe 31 is connected with the bypass pipe 32.

Further, the main unit 2 is provided with a controller 10, which controls the whole operation of the hot water supply device 1. The controller 10 is an electronic circuit unit composed of a CPU, a memory, various interface circuits and the like, which are not illustrated. The controller 10 executes a control program for the hot water supply device 1 stored in the memory so as to function as a hot water supply control unit 11 and a heat exchange state determiner 12.

When the faucet 44 is turned on and the running water sensor 29 detects a flow rate that is an ignition flow rate or higher, i.e. when the running water is detected, the hot water supply control unit 11 sets the burner 22 to a combustion mode to carry out a hot water supply operation. Meanwhile, when the faucet 44 is turned off and the flow rate detected by the running water sensor 29 becomes less than the ignition flow rate, i.e. when the running water is no longer detected, the hot water supply control unit 11 sets the burner 22 to an extinction mode to stop the hot water supply operation.

In the hot water supply operation, the hot water supply control unit 11 adjusts the opening degree of the gas proportional valve 25 and the rotational velocity of the combustion fan 23 to change the combustion amount of the burner 22 such that the temperature detected by the hot water supply temperature sensor 27 becomes a desired hot water supply temperature set by the remote control 50.

The heat exchange state determiner 12 carries out heat exchanger clogging determination processing for determining whether the heat exchanger 21 has been clogged due to the adhesion of lime scale. The heat exchange state determiner 12 carries out the heat exchanger clogging determination processing when the faucet is turned on to start the hot water supply operation without an "instruction for checking the heat exchange state" given by operating the remote control 50, which will be discussed hereinafter (other than the case where an operator operates the "instruction for checking the heat exchange state" and turns on the faucet 44 according to an audio guidance).

In the heat exchanger clogging determination processing, if the hot water supply operation stops after the hot water supply operation continues for a predetermined time (e.g. 10 minutes) or longer, the heat exchange state determiner 12 measures a post-boiling temperature Tup, which denotes the rise width of the temperature detected by the heat exchange outlet temperature sensor 26 (hereinafter referred to as the heat exchange outlet temperature Tout) from the time point at which the hot water supply operation was stopped.

Then, the heat exchange state determiner 12 compares the post-boiling temperature Tup with a second threshold temperature Bth, which is a threshold value for determining the clogging of the heat exchanger 21 attributable to the adhesion of lime scale. If the post-boiling temperature Tup is higher than the second threshold temperature Bth, then the heat exchange state determiner 12 displays an error on a display 51 of the remote control 50 and outputs an audio guidance "Clean the heat exchanger" through a speaker 56.

Further, if the operator who has cleaned the heat exchanger 21, as will be discussed hereinafter, gives an "instruction for checking the heat exchange state" by operating the remote control 50 (e.g. by a special operation, such as pressing an operation switch 55 while holding an UP switch 53 and a DOWN switch 54 pressed at the same time), then the heat exchange state determiner 12 carries out the heat exchange success determination processing for determining whether the water in the heat exchanger 21 is smoothly passing after the lime scale has been removed from the heat exchanger 21. The heat exchange success determination processing will be discussed hereinafter.

Figure 2:
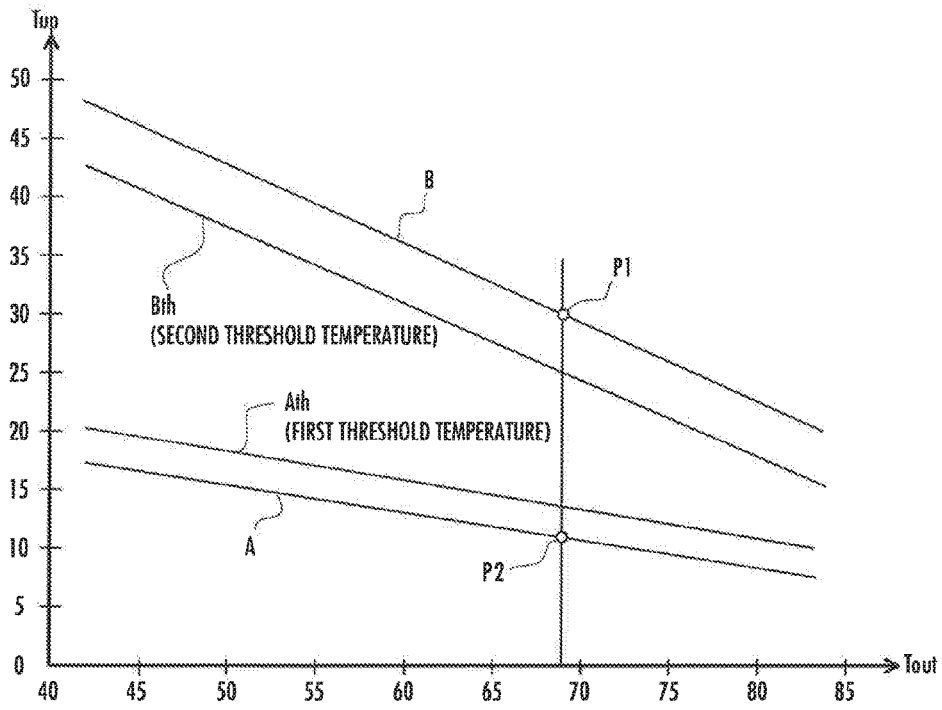
FIG. 2 is an explanatory chart illustrating a determination of whether a heat exchanger has been clogged by the adhesion of lime scale and a determination of whether the heat exchanger has been successfully cleaned.

FIG. 2 illustrates the relationship of correspondence between the heat exchange outlet temperature Tout and the post-boiling temperature Tup, the axis of abscissa indicating the heat exchange outlet temperature Tout at the time point when the hot water supply operation stops, and the axis of ordinate indicating the post-boiling temperature Tup. Referring to FIG. 2, A denotes the correspondence relationship in a state in which there is no adhesion of lime scale in the heat exchanger 21 (at the time of, for example, starting the use of the hot water supply device 1 that is newly provided or at the time of delivery inspection at a plant). Further, B denotes the correspondence relationship in a state in which lime scale has built up in the heat exchanger 21.

If the heat exchange outlet temperature Tout at the point when the hot water supply operation stops remains the same, then the post-boiling temperature Tup increases as the lime scale builds up in the heat exchanger 21 (shifting from A to B). For example, when the heat exchange outlet temperature Tout is 69° C., at P2 when there is no adhesion of lime scale in the heat exchanger 21, the post-boiling temperature Tup is 11° C. At point P1 when the lime scale has built up in the heat exchanger 21, the post-boiling temperature Tup is 30° C.

Hence, according to the present embodiment, a second threshold temperature Bth for determining the clogging of the heat exchanger is decided on the basis of the heat exchange outlet temperature Tout, as illustrated in FIG. 2. Further, a first threshold temperature Ath for the heat exchange state determiner 12 to determine whether water is smoothly running in the heat exchanger 21 is decided on the basis of the heat exchange outlet temperature Tout, as illustrated in FIG. 2.

Referring now to FIG. 3, the operation for cleaning the heat exchanger 21 will be described according to the flowchart given in FIG. 4. As illustrated in FIG. 3, the operation for cleaning the heat exchanger 21 is carried out by connecting a cleaning machine 70 to the hot water supply device 1.

The cleaning machine 70 has a cleaning liquid tank 73 in which a cleaning liquid 74 (acetic acid or the like) for removing lime scale is stored, a cleaning forward pipe 71 having one end thereof disposed in the cleaning liquid tank 73, a cleaning backward pipe 72, a circulating pump 75 which is provided on the way of the cleaning forward pipe 71 to take up the cleaning liquid 74 from the cleaning liquid tank 73 into the cleaning forward pipe 71, and a timer 76 for checking cleaning execution time.

Figure 4:
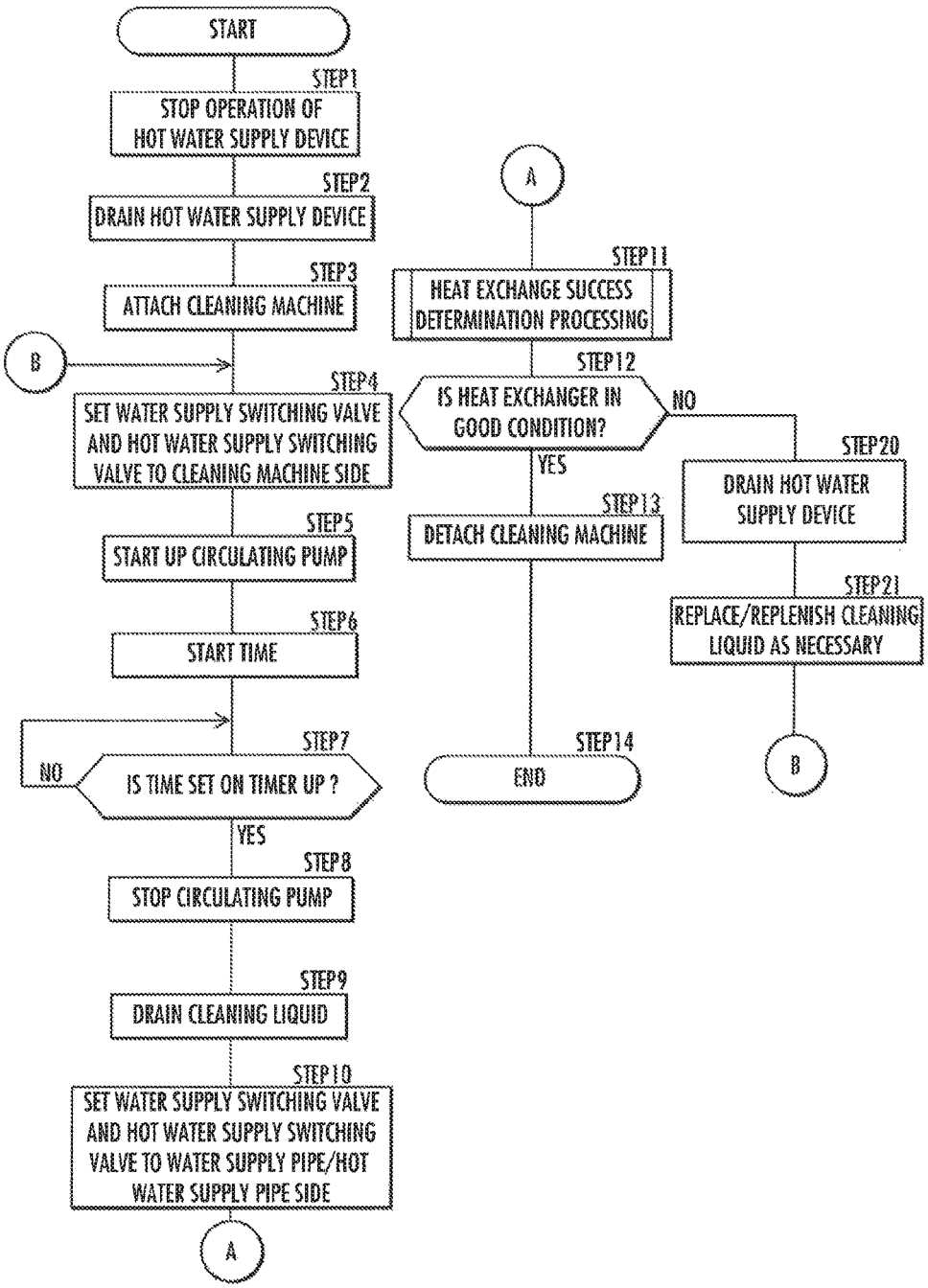
FIG. 4 is a flowchart illustrating an operation for cleaning the heat exchanger.

According to the flowchart of FIG. 4, an operator who cleans the heat exchanger 21 first stops the operation of the hot water supply device 1 in STEP1, and drains the hot water supply device 1 in STEP2. In the subsequent STEP3, the operator connects the cleaning forward pipe 71 to the water supply switching valve 40, connects the cleaning backward pipe 72 to the hot water supply switching valve 42, and attaches the cleaning machine 70 to the hot water supply device 1, as illustrated in FIG. 3.

Next, in STEP4, the operator operates the water supply switching valve 40 to close the path from the water pipe 41 to the water supply pipe 30 and to open the path from the cleaning forward pipe 71 to the water supply pipe 30. The operator also operates the hot water supply switching valve 42 to close the path from the hot water supply pipe 31 to the hot water supply piping 43 and to open the path from the hot water supply pipe 31 to the cleaning backward pipe 72.

Subsequently, in STEP5, the operator starts up the circulating pump 75. This causes the cleaning liquid to circulate through the path of the cleaning liquid tank 73→the cleaning forward pipe 71→the water supply pipe 30→the heat exchanger 21/the bypass pipe 32→the hot water supply pipe 31→the cleaning backward pipe 72→the cleaning liquid tank 73, thus starting the removal of the lime scale in the heat exchanger 21.

In the next STEP6, the operator starts the timer 76 and when the time set on the timer 76 is up in STEP7, the operator stops the circulating pump 75 in STEP8. In the following STEP9, the operator drains the cleaning liquid from the hot water supply device 1, and in STEP10, the operator operates the water supply switching valve 40 to close the path from the cleaning forward pipe 71 to the water supply pipe 30 and to open the path from the water pipe 41 to the water supply pipe 30.

Further, the operator operates the hot water supply switching valve 42 to close the path from the hot water supply pipe 31 to the cleaning backward pipe 72 and to open the path from the hot water supply pipe 31 to the hot water supply piping 43.

Operating the water supply switching valve 40 and the hot water supply switching valve 42 enables the hot water supply operation of the hot water supply device 1. Then, in the subsequent STEP11, the operator gives the "instruction for checking the heat exchange state" by operating the remote control 50 so as to direct the heat exchange success determination processing to be carried out. In the heat exchange state determination processing, if it is determined that the heat exchanger 21 has been successfully cleaned, then an audio guidance "Cleaned OK" is output through the speaker 56 of the remote control 50. The output of the audio guidance "Cleaned OK" corresponds to the notification of successful heat exchange in the present invention. The heat exchange state determination processing will be discussed in more detail hereinafter.

If the heat exchanger 21 has been inadequately cleaned, then an audio guidance "Clean again" will be output through the speaker 56 of the remote control 50. The output of the audio guidance "Clean again" corresponds to the notification urging the cleaning of a heat exchanger in the present invention. The notification of successful heat exchange and the notification urging the re-cleaning of the heat exchanger may be effected by a method other than the output of the audio guidance. For example, the notification may be displayed on the display 51 of the remote control 50 or may be given by sounding a buzzer through the speaker 56.

Next, in STEP12, the operator recognizes the audio guidance ("Cleaned OK" or "Clean again") and determines whether the cleaning has been successfully performed. If the cleaning has been successfully performed, i.e. if the audio guidance "Cleaned OK" is given, then the operator proceeds to STEP13 in which the operator disconnects the cleaning forward pipe 71 from the water supply switching valve 40, disconnects the cleaning backward pipe 72 from the hot water supply switching valve 42, and removes the cleaning machine 70 from the hot water supply device 1 to finish the cleaning operation.

Meanwhile, if the cleaning is inadequate, i.e. if the audio guidance "Clean again" is output, then the procedure branches away from STEP12 to STEP20. The operator drains the hot water supply device 1 and replaces or replenishes the cleaning liquid 74 in the cleaning liquid tank 73, as necessary, in the subsequent STEP21, and returns to STEP4. Then, the operator repeats the operation for cleaning the heat exchanger 21 by the processing from STEP4 and after.

Referring now to the flowchart given in FIG. 5, the procedure for carrying out the heat exchange success determination processing will be described. The heat exchange state determiner 12 carries out the heat exchange success determination processing when the operator operates the remote control 50 as described above.

The heat exchange state determiner 12 reads the data on the first threshold temperature Ath retained in a memory (not illustrated) in STEP30 and outputs an audio guidance "Turn faucet on" through the speaker 56 of the remote control 50 in the next STEP31. When the operator turns the faucet 44 on in response to the audio guidance, the water supply from the water pipe 41 to the water supply pipe 30 is begun.

When the flow rate detected by the running water sensor 29 reaches the ignition flow rate or more in the subsequent STEP32, the hot water supply operation is started by the hot water supply control unit 11. Then, in the next STEP33, the heat exchange state determiner 12 causes the hot water supply control unit 11 to carry out the hot water supply operation such that the heat exchange outlet temperature Tout becomes a determination temperature Tj. The start of the hot water supply operation corresponds to the start of the hot water supply operation in response to the instruction for checking the heat exchange state in the present invention.

Then, when a predetermined time (e.g. 10 minutes) elapses in the next STEP34, the heat exchange state determiner 12 proceeds to STEP35 to output an audio guidance "Turn faucet off" through the speaker 56 of the remote control 50. When the operator turns the faucet 44 off in response to the audio guidance, the water supply from the water pipe 41 to the water supply pipe 30 is stopped.

When the flow rate detected by the running water sensor 29 has reduced to less than the ignition flow rate in the subsequent STEP36 after the water supply from the water pipe 41 to the water supply pipe 30 is stopped, the heat exchange state determiner 12 proceeds to STEP37 to stop the hot water supply operation.

In the subsequent STEP38, the heat exchange state determiner 12 detects the heat exchange outlet temperature Tout and measures the post-boiling temperature Tup.

In STEP39, the heat exchange state determiner 12 compares the post-boiling temperature Tup and the first threshold temperature Ath to determine whether the post-boiling temperature Tup is lower than the first threshold temperature Ath.

If the post-boiling temperature Tup is lower than the first threshold temperature Ath, then it is determined that the heat exchanger 21 has been successfully cleaned. Hence, the heat exchange state determiner 12 proceeds from STEP39 to STEP40 wherein the heat exchange state determiner 12 outputs the audio guidance "Cleaned OK" through the speaker 56 of the remote control 50, and then proceeds to STEP41 to end the processing.

Meanwhile, if the post-boiling temperature Tup is the first threshold temperature Ath or higher, then it is determined that the heat exchanger 21 has been inadequately cleaned. Hence, the heat exchange state determiner 12 branches away from STEP39 to STEP50 to output the audio guidance "Clean again" through the speaker 56 of the remote control 50, and proceeds to STEP41 to end the processing.

Referring now to the flowchart given in FIG. 6, the processing for deciding the determination temperature Tj and the first threshold temperature Ath by the heat exchange state determiner 12 will be described. When the use of the hot water supply device 1 is begun (e.g. when there is no buildup of lime scale in the heat exchanger 21 of the hot water supply device 1 newly installed in a house or at the time of a delivery inspection at a plant or the like), the heat exchange state determiner 12 carries out the processing in accordance with the flowchart of FIG. 6 to decide the determination temperature Tj and the first threshold temperature Ath.

The heat exchange state determiner 12 waits until the hot water supply operation is started by the hot water supply control unit 11 in STEP60, and proceeds to STEP61. Then, in the loop formed of the subsequent STEP61 and STEP70, the heat exchange state determiner 12 waits until a set time (e.g. 10 minutes) elapses in STEP61 or the hot water supply operation is stopped in STEP70.

When the set time has elapsed in STEP61 (when it is determined that the hot water supply operation has continued for a set time or longer and the temperature of the hot water supplied from the heat exchanger 21 has stabilized), the heat exchange state determiner 12 proceeds to STEP62 and waits for the hot water supply operation to stop.

When the hot water supply operation stops in STEP62, the heat exchange state determiner 12 proceeds to STEP63 and decides the heat exchange outlet temperature Tout at the time point when the hot water supply operation stopped, i.e. when the circulation of water in the heat exchanger 21 stopped and the burner 22 was turned off, as the determination temperature Tj, which is then stored in the memory.

In the subsequent STEP64, the heat exchange state determiner 12 detects the degree of the rise in the heat exchange outlet temperature Tout from the time point when the hot water supply operation stopped, and measures the post-boiling temperature Tup. Then, the heat exchange state determiner 12 decides a temperature that is slightly higher than the post-boiling temperature Tup as the first threshold temperature Ath, and stores the data of the first threshold temperature Ath in the memory.

Figure 6:
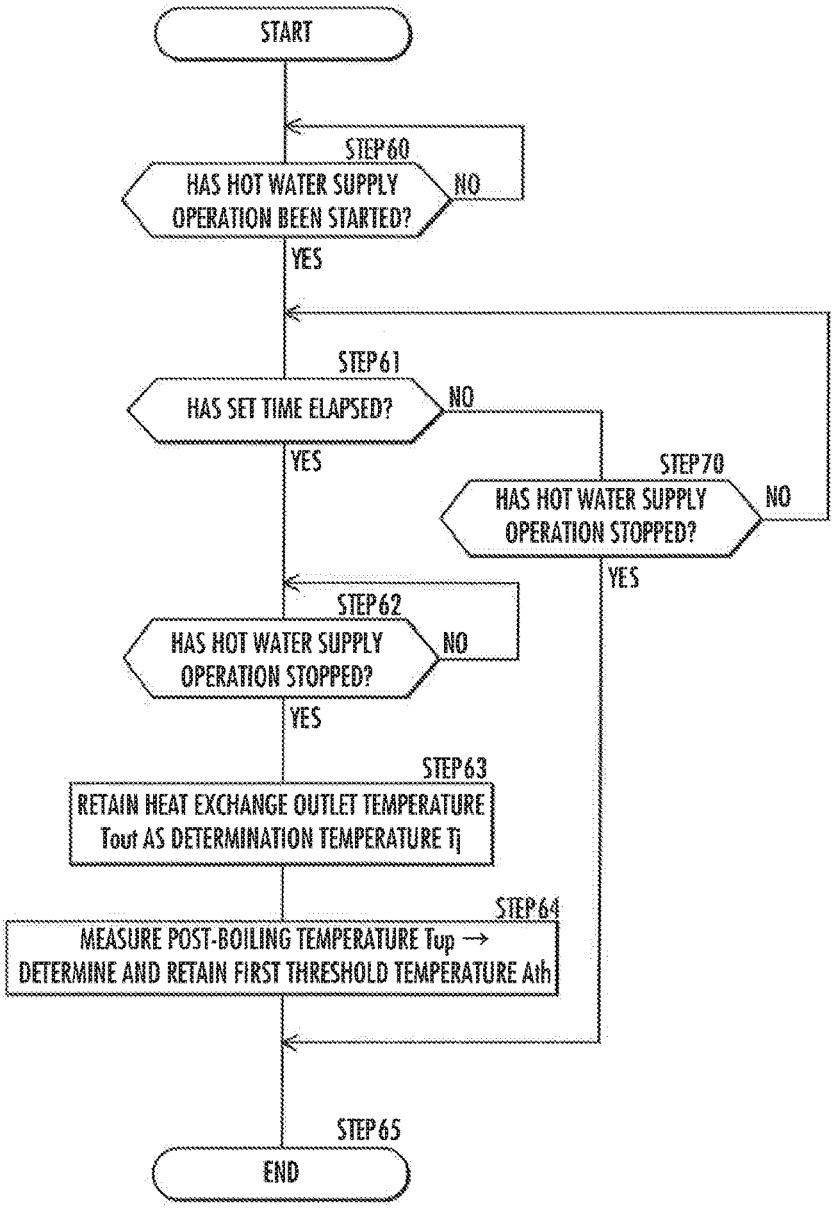
FIG. 6 is a flowchart illustrating the processing for setting a determination temperature and a first threshold temperature.

In the present embodiment, the determination temperature Tj and the first threshold temperature Ath have been decided by the processing of the flowchart given in FIG. 6 on the basis of the actual measured values of the heat exchange outlet temperature Tout and the post-boiling temperature Tup obtained when the hot water supply operation is actually carried out. Alternatively, however, the determination temperature Tj and the first threshold temperature Ath may be decided by calculation based on experiments or design values.

Further, in the present embodiment, the description has been given of the hot water supply device 1 provided with the burner 22 using gas as the fuel. However, the present invention can be applied also to a hot water supply device provided with a burner that burns a different type of fuel, such as a burner using oil as the fuel.

Figure 5:
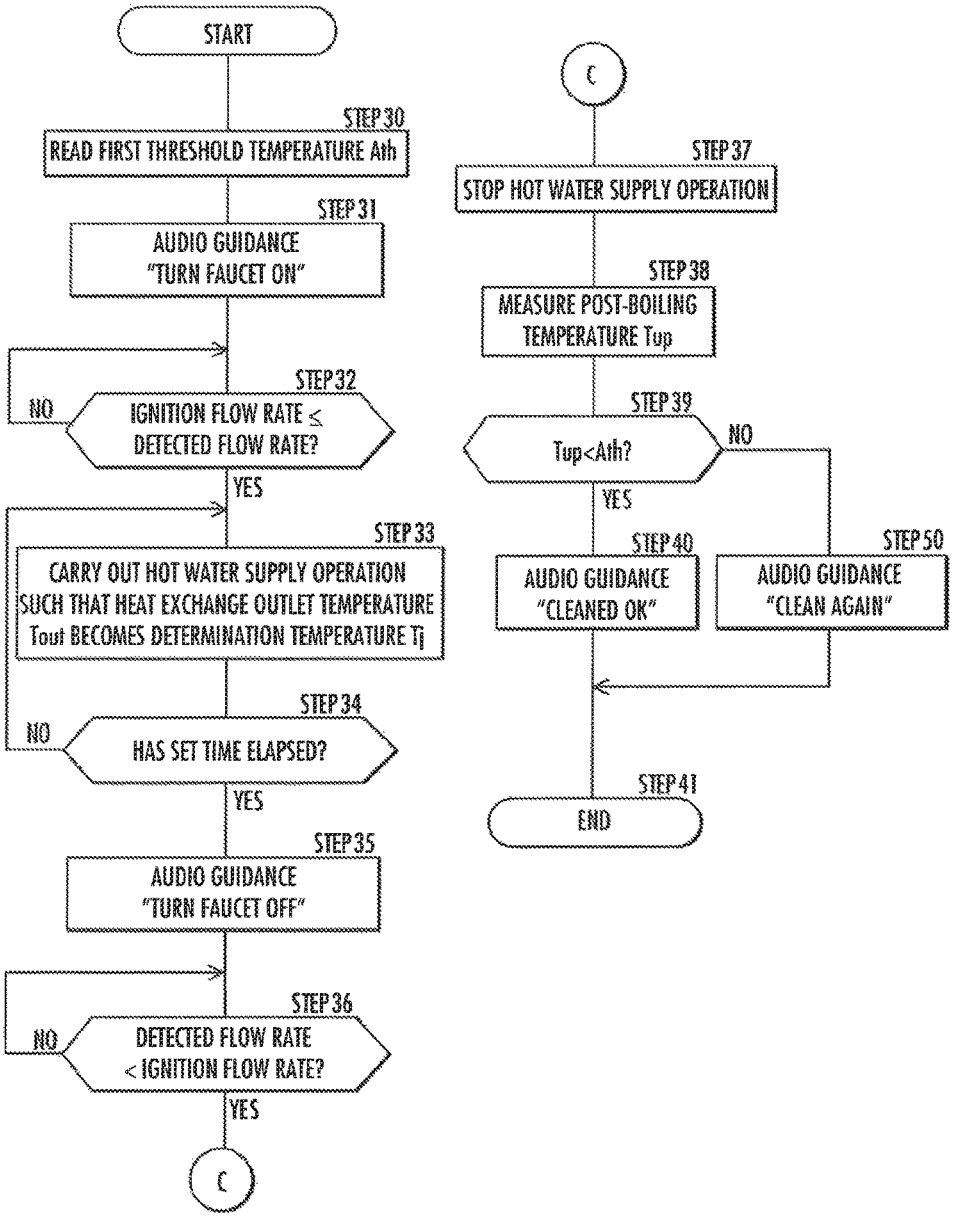
FIG. 5 is a flowchart illustrating a heat exchange success determination processing.

Further, in the present embodiment, the audio guidance "Clean again" has been output if the post-boiling temperature Tup is equal to or higher than the first threshold temperature Ath in the flowchart given in FIG. 5. However, the advantages of the present invention can be obtained even if the audio guidance is not output.

Further, according to the present embodiment, in the flowchart given in FIG. 5, the audio guidance "Turn faucet on" has been output in STEP31 and the audio guidance "Turn faucet off" has been output in STEP35 thereby to urge the operator to open and close the faucet 44.

However, if the supply and the supply stop of the water from the water pipe to the water supply pipe 30 can be switched by controlling an on-off valve, as in the case where a hot water bathtub filling pipe (not illustrated), which is branched away from the hot water supply pipe 31 and connected to a bathtub (not illustrated), and an on-off valve (not illustrated), which opens/closes the hot water bathtub filling pipe, are provided, then cleaning completion determination processing may be carried out by switching the on-off valve between an open valve state and a closed valve state without outputting the foregoing audio guidance.

Further, in the present embodiment, the heat exchange outlet temperature sensor 26 has been provided on the hot water supply pipe 31 side in the vicinity of the place of connection between the heat exchanger 21 and the hot water supply pipe 31. Alternatively, however, the heat exchange outlet temperature sensor 26 may be provided on the heat exchanger 21 side in the vicinity of the place of connection between the heat exchanger 21 and the hot water supply pipe 31.

What is claimed is:

1. A hot water supply device comprising:

a heat exchanger connected to a water supply pipe and a hot water supply pipe;

a burner that heats the heat exchanger;

a heat exchange outlet temperature sensor that detects a temperature of water in the heat exchanger or the hot water supply pipe in a vicinity of a connection between the heat exchanger and the hot water supply pipe;

a running water sensor that detects a presence of running water in the heat exchanger;

a hot water supply controller that carries out a hot water supply operation in which the burner is turned on to heat water circulating in the heat exchanger in a case where running water is detected by the running water sensor, and turns the burner off to stop the hot water supply operation in a case where the running water is not detected by the running water sensor; and a heat exchange state determiner which, in a case where the hot water supply operation stops after the hot water supply operation is started in response to a predetermined instruction for checking a heat exchange state, carries out heat exchange success determination processing in which a post-boiling temperature, which is a temperature rise of water in the heat exchanger by residual heat from a time point when the hot water supply operation is stopped, is measured based on a temperature detected by the heat exchange outlet temperature sensor, and the post-boiling temperature and a first threshold temperature are compared, and performs a predetermined successful heat exchange notification in a case where the post-boiling temperature is lower than the first threshold temperature, and in a case where the hot water supply operation stops after the hot water supply operation is started independently of the instruction for checking a heat exchange state, carries out heat exchanger clogging determination processing in which the post-boiling temperature is measured and the post-boiling temperature is compared with a second threshold temperature, which is higher than the first threshold temperature, and performs a predetermined heat exchanger clogging notification in a case where the post-boiling temperature is higher than the second threshold temperature.

2. The hot water supply device according to claim 1, wherein the heat exchange state determiner performs a notification for urging cleaning of the heat exchanger in a case where the post-boiling temperature is the first threshold temperature or higher in the heat exchange success determination processing.

3. The hot water supply device according to claim 1, wherein, in a case where the instruction for checking the heat exchange state is performed, the heat exchange state determiner causes the hot water supply controller to carry out the hot water supply operation such that the temperature detected by the heat exchange outlet temperature sensor becomes a predefined determination temperature, and the first threshold temperature is set according to the determination temperature.

4. The hot water supply device according to claim 3, wherein, in a case where the post-boiling temperature is the first threshold temperature or higher in the heat exchange success determination processing, the heat exchange state determiner performs a notification for urging cleaning of the heat exchanger.

* * * * *